United States Patent [19]

King et al.

[11] 4,205,407

[45] Jun. 3, 1980

[54] QUICK-CHANGE BRUSH HEAD

[75] Inventors: Gary N. King; Harold DePriest, both of Tulsa, Okla.

[73] Assignee: Crutcher Resources Corporation, Houston, Tex.

[21] Appl. No.: 42,609

[22] Filed: May 25, 1979

[51] Int. Cl.[2] ..... B08B 9/02

[52] U.S. Cl. ..... 15/88; 15/179

[58] Field of Search ..... 15/88, 104.04, 179, 15/180

[56] References Cited

U.S. PATENT DOCUMENTS

| | | | |
|---|---|---|---|
| 1,901,247 | 3/1933 | Kinzbach | 15/88 |
| 2,641,008 | 6/1953 | Smith | 15/88 |
| 3,495,288 | 2/1970 | Ford | 15/88 |
| 3,641,608 | 2/1972 | Kratt | 15/88 |
| 3,916,469 | 11/1975 | Anthem et al. | 15/88 |
| 3,988,798 | 11/1976 | Kratt | 15/88 |

FOREIGN PATENT DOCUMENTS

| | | | |
|---|---|---|---|
| 379294 | 7/1973 | U.S.S.R. | 15/88 |

*Primary Examiner*—Edward L. Roberts

*Attorney, Agent, or Firm*—Richards, Harris & Medlock

[57] ABSTRACT

A brush head assembly (12) for use in a pipe cleaning machine includes a pair of end rings (26, 28). A plurality of arms (30) are pivotally connected about the second end ring (28). Cross members (44) supporting brushes (50) extend between the arms (30) and the first end ring (26). The brush head assembly (12) is adjustable to accommodate different predetermined pipe sizes by pivotal adjustment of the arms (30) and replacement of the first end ring (26).

8 Claims, 4 Drawing Figures

FIG. 1
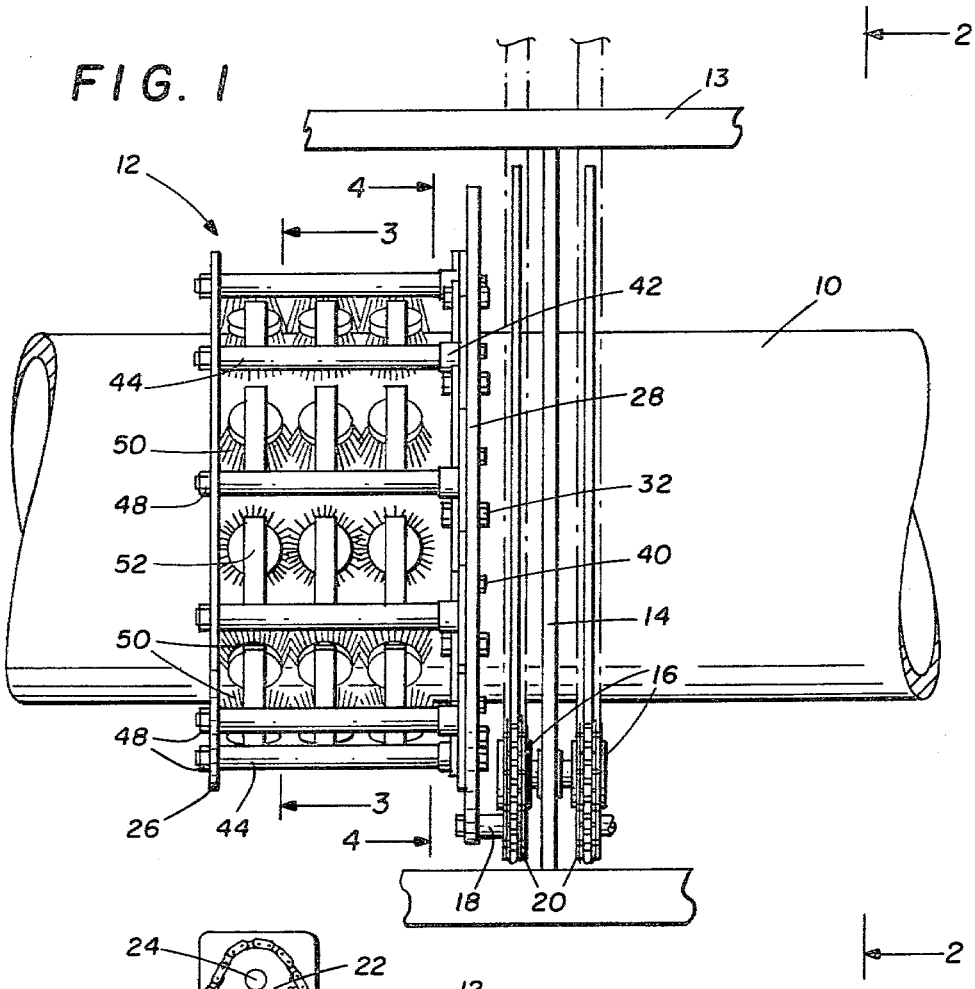
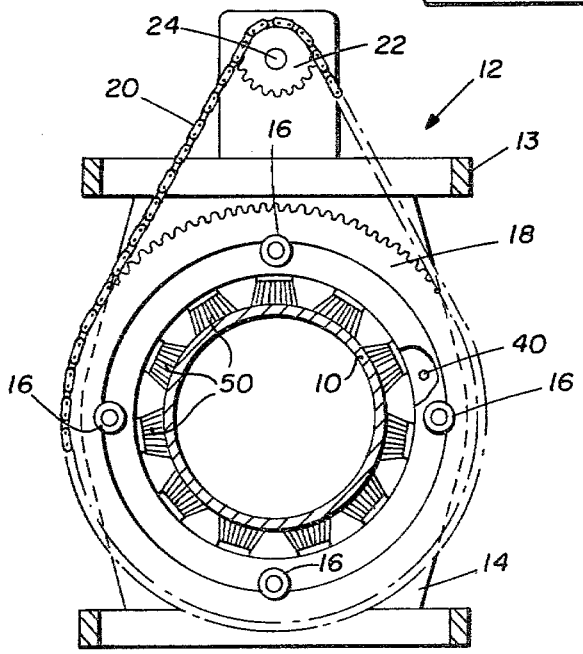
FIG. 2

QUICK-CHANGE BRUSH HEAD

TECHNICAL FIELD

The present invention relates in general to a device for cleaning the external surface of a pipe. More particularly, this invention concerns a quick-change brush head for use in a pipe cleaning machine.

BACKGROUND ART

External pipe cleaning machines have been utilized in the pipeline industry for years. The outside surfaces of the pipes are cleaned before application of primer, tape or other protective coatings. Proper surface preparation of the pipe is thus an important step in pipeline construction.

Since pipelines can be of various sizes, it is desirable for pipe cleaning machines to accommodate pipes of different diameters. To this end there have been several approaches to the design of the cleaning head assemblies in such machines. One approach has been to mount the cleaning elements on pivotal arms which are biased inwardly by springs. Although more than one pipe size can be accommodated this way, engagement between the brushes and the pipe varies in accordance with the pipe size. The brushes are engaged with greater tension against larger pipes. Brush engagement with smaller pipes can be inadequate to properly clean the outside pipe surface. The angle of brush contact in assemblies of this type can also vary in accordance with the pipe diameter. Such self-adjusting assemblies are thus effective only for a relatively narrow range of pipe sizes.

Another approach has been to mount the brushes in fixed relationship. More uniform engagement and contact between the brushes and the pipe surface is achieved in this manner, but ease of adjustment is difficult. To effect a changeover in pipe size, it has heretofore been necessary to change several components in the mechanism. This in turn has required substantial disassembly and then reassembly of the mechanism, all of which is time consuming and therefore expensive in terms of labor. There is thus a need for an improved quick-change brush head for use in a pipe cleaning machine.

DISCLOSURE OF INVENTION

The present invention comprises a novel quick-change brush head which overcomes the foregoing and other difficulties associated with the prior art. In accordance with the invention, there is provided a brush head assembly which is easily adjustable to accommodate pipes of different diameters. The brushes are supported for contact with the outside pipe surface, yet the brush head assembly can be adjusted to fit predetermined pipe sizes without the substantial disassembly and reassembly that has characterized the prior art. Use of the present invention permits quicker changeover of the pipe cleaning machine, resulting in time and thus cost savings.

More specifically, the present invention comprises a brush head assembly for rotation about a pipe to effect cleaning thereof. The assembly includes a pair of end rings mounted in spaced apart relationship. A plurality of arms are pivotally connected around one ring. Brushes, scraper blades or other cleaning devices are pivotally supported on cross members connected between each pivotal arm and the other ring. Each arm can be adjustably secured to one ring in a plurality of predetermined pivotal positions. Changeover to accommodate another pipe size is accomplished by repositioning the arms and replacing only one end ring.

BRIEF DESCRIPTION OF DRAWINGS

A more complete understanding of the invention can be had by referring to the following detailed description in conjunction with the accompanying drawings, wherein:

FIG. 1 is an elevational view of a pipe being cleaned by a brush head assembly incorporating the present invention;

FIG. 2 is a reduced size end view (partially cutaway) of FIG. 1;

DETAILED DESCRIPTION

Figure 3:
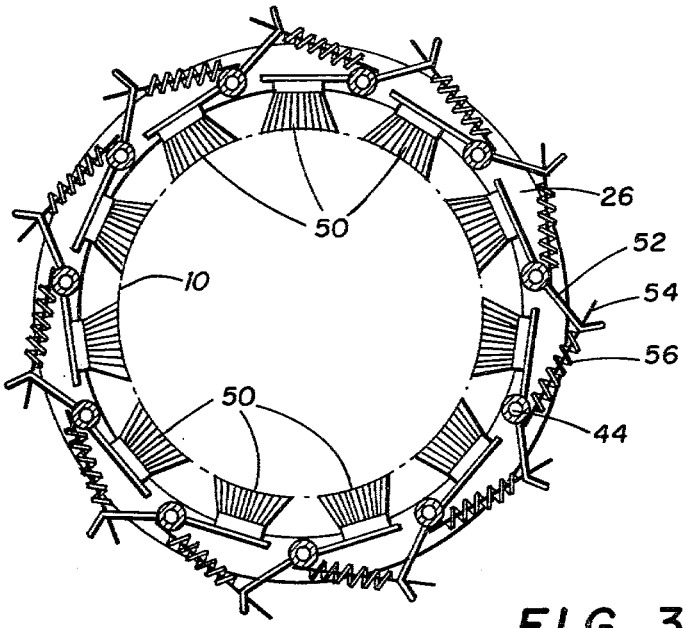
FIG. 3 is a sectional view of FIG. 1 taken along line 3—3 in the direction of the arrows.

Referring now to the drawings, wherein like reference numerals designate like or corresponding parts throughout the several views, and particularly referring to FIG. 1, there is shown a pipe 10 extending through a brush head assembly 12 incorporating the invention. The brush head assembly 12 comprises a portion of a pipe cleaning machine which has been omitted from FIG. 1 for clarity. The pipe cleaning machine includes a frame 13 which supports brush head assembly 12 for rotation about pipe 10.

In some pipe cleaning machins, two counter-rotating brush head assemblies are employed to eliminate torque reaction of pipe 10. FIG. 1 illustrates a single brush head assembly 12. In a dual head pipe cleaning machine, the second brush head assembly would typically be positioned to the right of assembly 12 shown in FIG. 1. It will thus be understood that brush head assembly 12 can be used in single or dual head pipe cleaning machines. The novel construction of brush head assembly 12 permits quick changeover of the cleaning machine to accommodate pipe of a different size, as will be more fully described hereinafter.

Referring to FIGS. 1 and 2, brush head assembly 12 is supported for rotation by yoke 14. Yoke 14 is stationary with respect to both pipe 10 and assembly 12, and is shaped in the form of a ring. Yoke 14 is supported by frame 13. Yoke 14 includes a plurality of rollers 16 secured thereto in circumferentially spaced intervals. Rollers 16 support a ring sprocket 18, which is secured to the brush head assembly 12. A roller chain 20 is constrained around ring sprocket 18 and a drive sprocket 22 connected to an output shaft 24. It will thus be apparent that brush head assembly 12 rotates to clean the exterior surface of pipe 10 as the pipe advances through the cleaning machine.

Figure 4:
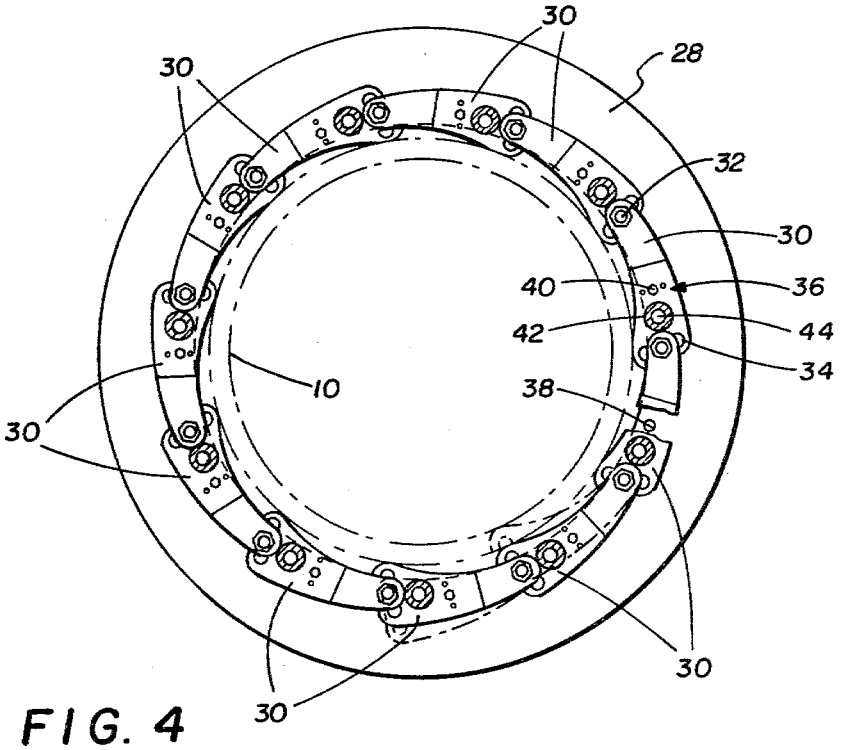
FIG. 4 is a sectional view (partially cutaway) of FIG. 1 taken along line 4—4 in the direction of the arrows.

The constructional details of brush head assembly 12 are best shown in FIGS. 1, 3 and 4. Assembly 12 includes first and second end rings 26 and 28. Second end ring 28 is attached to ring sprocket 18. A plurality of arms 30 are pivotally mounted about second end ring 28. Each arm 30 is pinned to ring 28 by a bolt 32. According to the preferred construction of the invention, each arm 30 includes a slot 34 through which extends the bolt 32 for the adjacent arm. Each arm 30 is thus pivotally supported by one bolt 32 and pivotally constrained by another bolt. A set of apertures 36 are also provided in each arm 30. Pivotal movement of arms 30 causes the apertures 36 therein to register with corresponding apertures 38 in ring 28. Preferably, one aperture 38 is provided for each arm 30. It will be understood that, in the alternative, arms 30 can be provided with single apertures and sets of corresponding apertures can be formed in second end ring 28, if desired. A bolt 40 secures each arm 30 through a registering pair of apertures 36 and 38. Arms 30 can thus be adjustably secured in predetermined pivotal positions.

The end rings 26 and 28 are interconnected. Each arm 30 on second end ring 28 is provided with a socket 42. Cross members 44 extend between arms 30 and first end ring 26. Each socket 42 receives one end of a cross member 44. Preferably, cross members 44 are pinned to sockets 42. The other ends of cross members 44 are reduced and threaded, and extend through holes formed in first end ring 26. Nuts 48 secure first end ring 26 to cross members 44. First end ring 26 is thus removably secured to cross members 44.

The cross members 44 support the cleaning elements used by brush head assembly 12. As illustrated, three cup-type wire brushes 50 are pivotally mounted on each cross member 44. Brushes 50 in brush head assembly 12 are oriented radially inward for contact with pipe 10. Brushes 50 are supported on fingers 52 extending outwardly from arms 44. Guide rods 54 connected to adjacent arms 44 extend through slots in fingers 52. A compression spring 56 surrounds each rod 54 to bias each brush 50 against pipe 10. For clarity, guide rods 54 and springs 56 have been omitted from FIG. 1. The outside surface of pipe 10 is thus cleaned during rotation of brush head assembly 12.

Although the preferred embodiment of the invention incorporates brushes 50, it will be understood that any combination of brushes, scraper blades, cutters or other cleaning elements can be utilized in brush head assembly 12.

Changeover of brush head assembly 12 for operation with a different diameter pipe is accomplished as follows. First end ring 26 is disconnected and removed, followed by removal of bolts 40. Each arm 30 is then pivoted until the desired pair of apertures 36 and 38 register and permit reinsertion of corresponding bolt 40. Arms 30, cross members 44 and brushes 50 are thus positively repositioned in accordance with the size of the next pipe to be cleaned. The brush head assembly 12 can be adjusted to fit any one of several predetermined pipes, such as 26, 28 or 30 inch diameter pipe. A new first end ring 26 having a hole pattern in accordance with the new positions of cross members 44 is then reattached with nuts 48.

From the foregoing, it will be understood that the present invention comprises a unique pipe cleaning brush head assembly having numerous advantages over the prior art. One significant advantage involves the fact that the brush head assembly is adjustable for any one of a plurality of predetermined pipe sizes. Adjustment is accomplished significantly quicker because only one end ring must be removed and replaced. Other advantages of the invention will be apparent to those skilled in the art.

Anthough particular embodiments of the invention have been illustrated in the accompanying drawings and described in the foregoing detailed description, it will be understood that the invention is not limited to the embodiments disclosed, but is intended to embrace any alternatives, modifications, and rearrangements and/or substitutions of parts or elements as fall within the spirit and scope of the invention.

We claim:

1. In a cleaner head assembly for use in a pipe cleaning machine, said assembly including a pair of end rings and cleaning elements supported by cross members connected between the end rings, the improvement comprising:

a plurality of arms pivotally connected about one end ring;

at least one of said cross members being connected to each of said arms; and means for adjustably securing each of said arms to said one end ring in a plurality of predetermined pivotal positions.

2. The cleaner head assembly of claim 1, wherein each arm includes an arcuate slot at one end and an aperture at the other end, and further including:

pin means extending through the aperture of each arm for pivotally connecting the arm to said one end ring, said pin means also extending through the slot in the adjacent arm.

3. The cleaner head assembly of claim 1, wherein the adjustable securing means comprises:

aperture means formed through each of said arms and a corresponding portion of said one end ring; and fastener means removably extending through the aperture means in each of said arms and said one end ring.

4. A quick-change cleaner head assembly for use in a pipe cleaning machine, comprising:

first and second end rings disposed in spaced apart relationship;

a plurality of arms pivotally connected about the second end ring for pivotal movement between inner and outer positions;

means for adjustably securing each of said arms to the second end ring in a plurality of predetermined pivotal positions; and cleaner means connected between said arms and the first ring for engaging the pipe.

5. The cleaner head assembly of claim 4, wherein the adjustable securing means comprises:

hole means formed through each of said arms and a corresponding portion of the second end ring; and fastener means removably extending through the hole means in each of said arms and the second end ring.

6. The cleaner head assembly of claim 4, wherein the cleaner means includes:

a plurality of cross members, each secured between the first end ring and one of said arms; and at least one cleaning element supported by each of said cross members.

7. The cleaner head assembly of claim 4, wherein each of said arms includes an arcuate slot at one end thereof and a hole at the other end, and further including:

pin means extending through the hole of each arm for pivotally connecting the arm to the second ring, said pin means also extending through the slot in the adjacent arm.

8. A quick-change brush head for use in a pipe cleaning machine, which comprises:

a first end ring surrounding the pipe;

a second end ring surrounding the pipe in spaced apart relationship with said first end ring;

a plurality of arms positioned circumferentially about the second end ring;

means for securing each of said arms to the second end ring for pivotal movement relative to the pipe;

means for adjustably securing each of said arms to the second end ring in a plurality of preselected pivotal positions;

a plurality of cross members, each connected between one of said arms and the first end ring;

a plurality of brushes, at least one brush being pivotally mounted on each of said cross members, for engaging the pipe during relative movement between the pipe and the brush head; and means for biasing each of said brushes into engagement with the pipe.

* * * * *